US010595707B2

(12) United States Patent
Singhal et al.

(10) Patent No.: US 10,595,707 B2
(45) Date of Patent: Mar. 24, 2020

(54) ADJUSTABLE RACK ASSEMBLIES AND END CAPS FOR APPLIANCES

(71) Applicant: Haier US Appliance Solutions, Inc., Wilmington, DE (US)

(72) Inventors: Arpit Singhal, Firozabad (IN); Justin Paul Mudd, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/983,284

(22) Filed: May 18, 2018

(65) Prior Publication Data

US 2019/0350434 A1 Nov. 21, 2019

(51) Int. Cl.
*A47L 15/50* (2006.01)
*A47B 88/437* (2017.01)

(52) U.S. Cl.
CPC ..... *A47L 15/503* (2013.01); *A47B 88/437* (2017.01)

(58) Field of Classification Search
CPC .... A47L 15/503; A47L 15/504; A47L 15/506; A47L 15/507; A47B 88/437; A47B 88/57; A47B 2210/0059; A47B 2210/17
See application file for complete search history.

(56) References Cited

U.S. PATENT DOCUMENTS 3,347,613 A 10/1967 Krzewina
3,982,802 A 9/1976 Bailey
4,535,524 A * 8/1985 Jenkins ..... A47B 88/487 29/453
5,061,020 A * 10/1991 Ulrich ..... A47L 15/507 312/228.1
5,242,222 A * 9/1993 Michael ..... A47B 88/57 16/95 R
5,433,516 A * 7/1995 Beals ..... A47B 47/02 312/257.1
6,412,892 B1 * 7/2002 Bonat ..... A47B 88/42 312/334.25
7,001,004 B2 * 2/2006 Bartloff ..... A47L 15/507 312/228.1
8,985,715 B2 * 3/2015 Merz ..... A47L 15/507 211/41.8
9,723,970 B1 * 8/2017 Carr ..... A47L 15/507
9,950,673 B2 * 4/2018 Granzotto ..... B60R 7/043
10,022,038 B2 * 7/2018 Hansen ..... A47B 88/487
(Continued)

FOREIGN PATENT DOCUMENTS

CN 100431467 C 11/2008

*Primary Examiner* — Patrick D Hawn
(74) *Attorney, Agent, or Firm* — Dority & Manning, P.A.

(57) ABSTRACT

Adjustable rack assemblies and end caps for appliances, such as a dishwasher appliance, is provided herein. A rack assembly may include a frame, a rack, a first front wheel, a second front wheel, and an end cap. The rack may be selectively mounted to the frame to receive articles for washing within a wash chamber, and may be slidable along the frame between an extended position and a retracted position. The first front wheel may be rotatably attached to the rack above the frame. The second front wheel may be rotatably attached to the rack below the first front wheel in vertical alignment therewith. The end cap may be attached to the frame at a forward end thereof. The end cap may define a top-end catch profile and a bottom-end relief profile.

18 Claims, 6 Drawing Sheets

(56) References Cited

U.S. PATENT DOCUMENTS

| | | | | |
|---|---|---|---|---|
| 2004/0201339 | A1* | 10/2004 | Dickson | A47B 88/40 312/334.45 |
| 2005/0039782 | A1* | 2/2005 | Kim | A47L 15/504 134/58 D |
| 2006/0066190 | A1* | 3/2006 | Hay | A47B 88/40 312/333 |
| 2006/0250058 | A1 | 11/2006 | Stevens et al. | |
| 2008/0231153 | A1* | 9/2008 | Cho | A47B 88/53 312/333 |
| 2009/0096338 | A1* | 4/2009 | Jahrling | A47L 15/504 312/334.5 |
| 2009/0151758 | A1* | 6/2009 | Kristensson | A47L 15/4257 134/201 |
| 2012/0104915 | A1* | 5/2012 | Jobst | A47L 15/507 312/228.1 |
| 2014/0132147 | A1* | 5/2014 | Tarcy | A47B 57/06 312/410 |

* cited by examiner

ADJUSTABLE RACK ASSEMBLIES AND END CAPS FOR APPLIANCES

FIELD OF THE INVENTION

The present subject matter relates generally to rack assemblies for appliances, such as dishwasher appliances.

BACKGROUND OF THE INVENTION

Various appliances have slidable rack assemblies for holding articles therein. For example, a dishwasher appliance is typically provided with one or more rack assemblies into which various articles may be loaded for cleaning. The rack assemblies may include features such as, for example, tines that hold and orient the articles to receive sprays of wash and rinse fluids during the cleaning process. The articles to be cleaned may include a variety of dishes, cooking utensils, silverware, and other items.

The size of the articles can vary significantly. For example, glasses are available in a variety of different heights. Dishes are manufactured with various diameters between large and small. Pots used for cooking can have different depths.

In order to accommodate the larger articles, some dishwasher appliances include an upper rack assembly of a dishwasher appliance with features for height adjustment of the rack assembly. Such adjustability allows for movement of the upper rack assembly along a vertical direction. By moving or lifting the upper rack to a higher vertical height setting, larger articles can be accommodated in, for example, a lower rack assembly positioned beneath the upper rack assembly. Conversely, by lowering the upper rack to a lower vertical height setting, larger articles can be accommodated in, for, the upper rack assembly.

Certain adjustment features have been proposed for providing height adjustability for a rack assembly. Typically, these features include multiple moving parts that may require the user to manipulate both the rack assembly and the adjustment features at the same time when lifting or lowering the rack assembly. For example, the user may be required to lower or lift the rack assembly while simultaneously depressing or squeezing a lever or other aspect of the adjustment feature. For certain users, these adjustment features can be difficult to operate.

In some appliances, an end cap is provided at a front end of the rack assembly to prevent excessive forward movement of the assembly. For instance, the end cap may catch a wheel rolling along a top portion of the rack assembly. If the assembly is adjustable between multiple heights (i.e., vertical height settings), a different wheel may be provided at each height to be received by the end cap. However, the end cap may risk interfering with lower elements, such as the lower wheels, of the assembly (e.g., during height adjustment operations). Some existing rack assemblies stagger the wheels at each different height so that they are offset (e.g., relative the direction that rack assembly slides). This offset may prevent the end cap from hitting or interfering with the other wheels, but it limits the amount of sliding travel for the rack assembly. In other words, it limits how far the rack assembly may be pulled out from the wash chamber of a dishwasher appliance at certain heights or height settings.

Accordingly, a rack assembly for an appliance that can be easily adjusted to different vertical positions would be useful. In particular, a rack assembly for an appliance that can be easily adjusted to different vertical positions without limiting the amount of sliding travel of the rack assembly would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a rack assembly is provided. The rack assembly may include a frame, a rack, a first front wheel, a second front wheel, and an end cap. The frame may be positioned within a wash chamber of a dishwasher appliance. The rack may be selectively mounted to the frame to receive articles for washing. The rack may be slidable along the frame in a transverse direction between an extended position and a retracted position. The first front wheel may be rotatably attached to the rack above the frame. The second front wheel may be rotatably attached to the rack below the first front wheel in vertical alignment with the first front wheel. The end cap may be attached to the frame at a forward end thereof. The end cap may define a top-end catch profile and a bottom-end relief profile. The top-end catch profile may be directed rearward along the transverse direction. The top-end catch profile may have a transverse profile segment and a vertical profile segment extending from and above the transverse profile segment to receive the first front wheel in the extended position. The bottom-end relief profile may be directed forward along the transverse direction.

In another exemplary aspect of the present disclosure, a rack assembly is provided. The rack assembly may include a frame, a rack, a first front wheel, a second front wheel, and an end cap. The frame may be positioned within a wash chamber of a dishwasher appliance. The rack may be selectively mounted to the frame to receive articles for washing. The rack may be slidable along the frame in a transverse direction between an extended position and a retracted position. The first front wheel may be rotatably attached to the rack above the frame. The second front wheel may be rotatably attached to the rack below the first front wheel in vertical alignment with the first front wheel. The end cap may be attached to the frame at a forward end thereof. The end cap may define a top-end catch profile and a bottom-end relief profile. The top-end catch profile may have a transverse profile segment and a vertical profile segment extending arcuately from and above the transverse profile segment to receive the first front wheel in the extended position. The vertical profile segment may define a top vertex. The bottom-end relief profile may have a concave profile segment defining a bottom vertex and being directed forward along the transverse direction. The top vertex may be defined forward relative to the bottom vertex in the transverse direction. Moreover, at least a portion of the transverse profile segment may be defined forward relative to the bottom vertex along the transverse direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 6 FIG. 5 provides a partial, cross-sectional side view of the exemplary rack assembly of FIG. 3, the rack assembly being in a lifted position.

DETAILED DESCRIPTION

Figure 1:
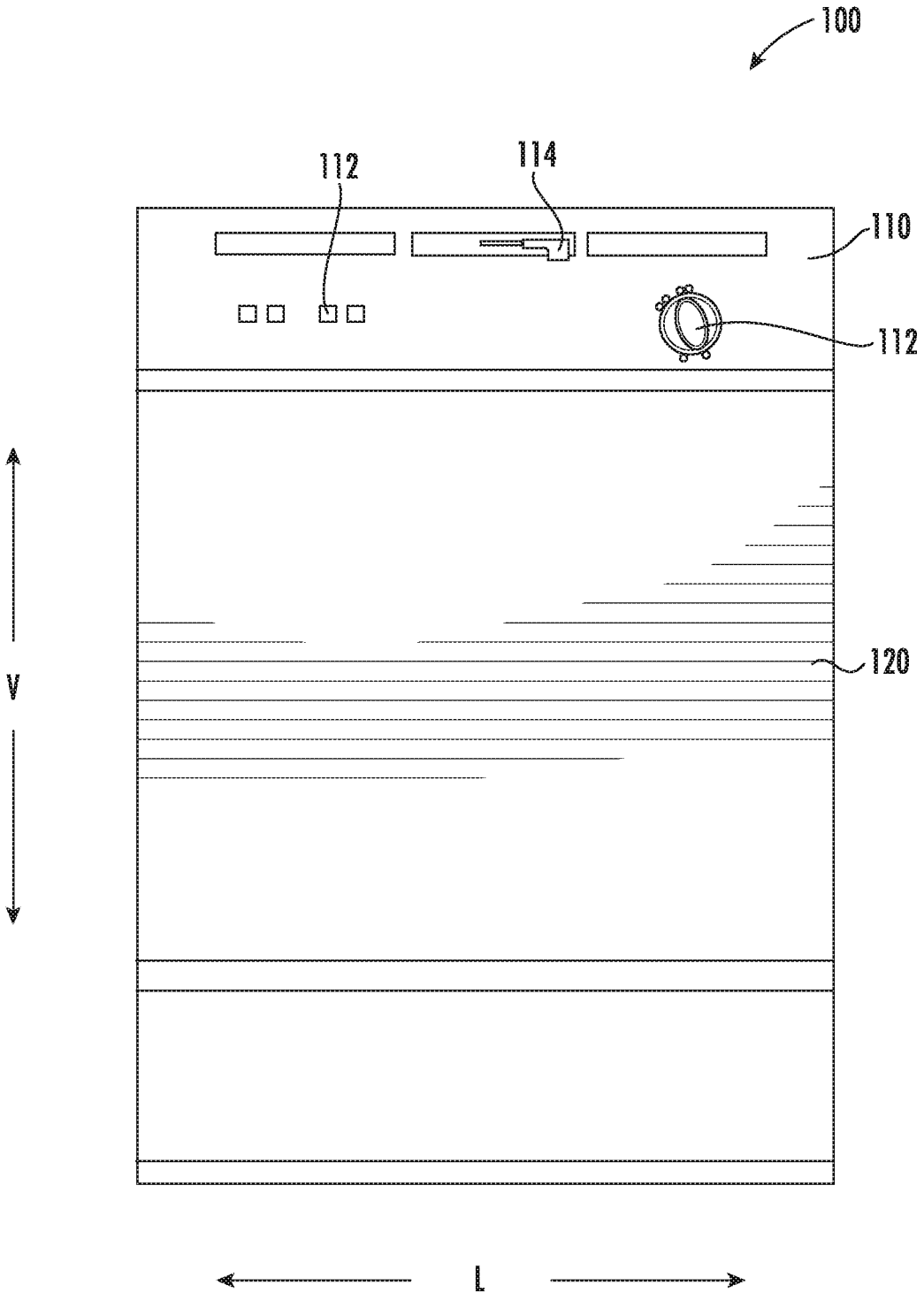
FIG. 1 provides a front view of a dishwasher appliance according to exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
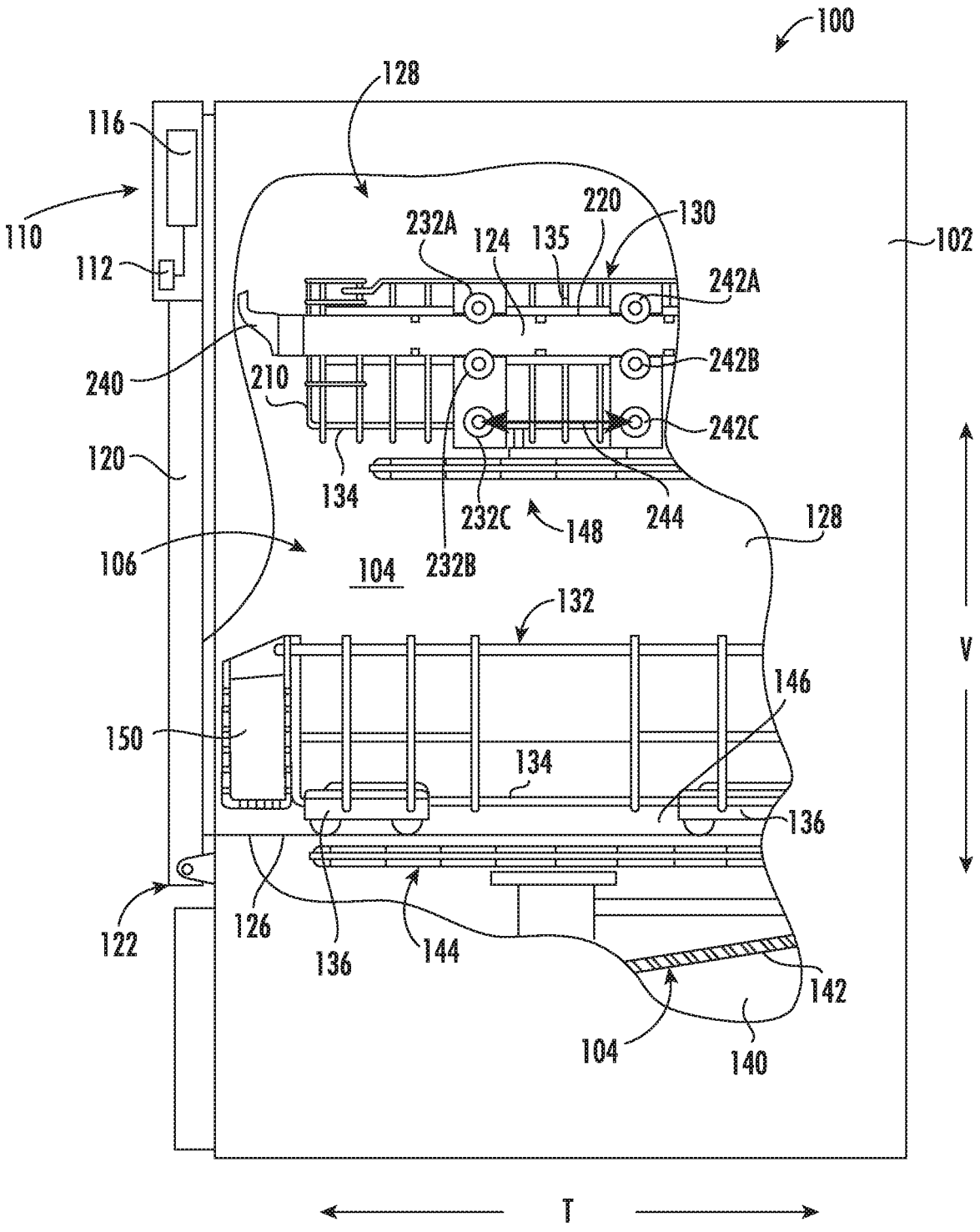
FIG. 2 provides a partial, cross-sectional side view of the exemplary dishwasher appliance of FIG. 1.

Turning now to the figures, FIGS. 1 and 2 depict a dishwasher appliance 100 according to an exemplary embodiment of the present disclosure. Dishwasher appliance 100 defines a vertical direction V, a lateral direction L (FIG. 1), and a transverse direction T (FIG. 2). The vertical, lateral, and transverse directions V, L, and T are mutually perpendicular and form an orthogonal direction system.

Dishwasher appliance 100 also includes a cabinet 102 (or chassis) having a tub 104 therein that defines a wash chamber 106. The tub 104 includes a front opening and a door 120 hinged at its bottom 122 for movement between a normally closed vertical position (shown in FIGS. 1 and 2), wherein the wash chamber 106 is sealed shut for washing operation, and a horizontal open position for loading and unloading of articles from dishwasher appliance 100. In some embodiments, a latch 114 is used to lock and unlock door 120 for access to chamber 106.

Slide assemblies 124 are mounted on opposing tub sidewalls 128 to support and provide for movement for a rack assembly (e.g., upper rack assembly 130). In some embodiments, lower guides 126 are positioned in opposing manner of the sides of chamber 106 and provide a ridge or shelf for roller assemblies 136 so as to support and provide for movement of lower rack assembly 132. Each of the upper and lower rack assemblies 130, 132 is include a rack (e.g., rack 210) fabricated into lattice structures including a plurality of elongated members 134 and 135 that extend in lateral (L), transverse (T), or vertical (V) directions. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry rack assemblies 130 and 132, respectively. Optionally, a silverware basket 150 may be removably attached to the lower rack assembly 132 for placement of silverware, small utensils, and the like, that are too small to be accommodated by the upper and lower racks 130, 132.

The dishwasher appliance 100 further includes a lower spray assembly 144 that is rotatably mounted within a lower region 146 of the wash chamber 106 and above a tub sump portion 142 so as to rotate in relatively close proximity to the lower rack 132. A mid-level spray assembly 148 is located in an upper region of the wash chamber 106 and may be located in close proximity to upper rack 130. Additionally, an upper spray assembly (not shown) may be located above the upper rack 130.

The lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below the bottom sump portion 142 of the tub 104, as generally recognized in the art. Each spray assembly includes an arrangement of discharge ports or orifices for directing washing liquid onto dishes or other articles located in the upper and lower racks 130, 132, respectively. The arrangement of the discharge ports in at least the lower spray assembly 144 provides a rotational force by virtue of washing fluid flowing through the discharge ports. The resultant rotation of the lower spray assembly 144 provides coverage of dishes and other articles with a washing spray.

Dishwasher appliance 100 is further equipped with a controller 116 to regulate operation of dishwasher appliance 100. Controller 116 may include a memory (e.g., non-transitive memory) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. In certain embodiments, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface 112 may include a display component, such as a digital or analog display device designed to provide operational feedback to a user. User interface 112 may be in communication with controller 116 via one or more signal lines or shared communication busses.

It should be appreciated that the invention is not limited to any particular style, model, or configuration of dishwasher appliance. Thus, the exemplary embodiment depicted in FIGS. 1 and 2 is for illustrative purposes only. For example, different locations may be provided for a user interface 112, different configurations may be provided for rack assemblies 130 and 132, and other differences may be applied as well.

Figure 3:
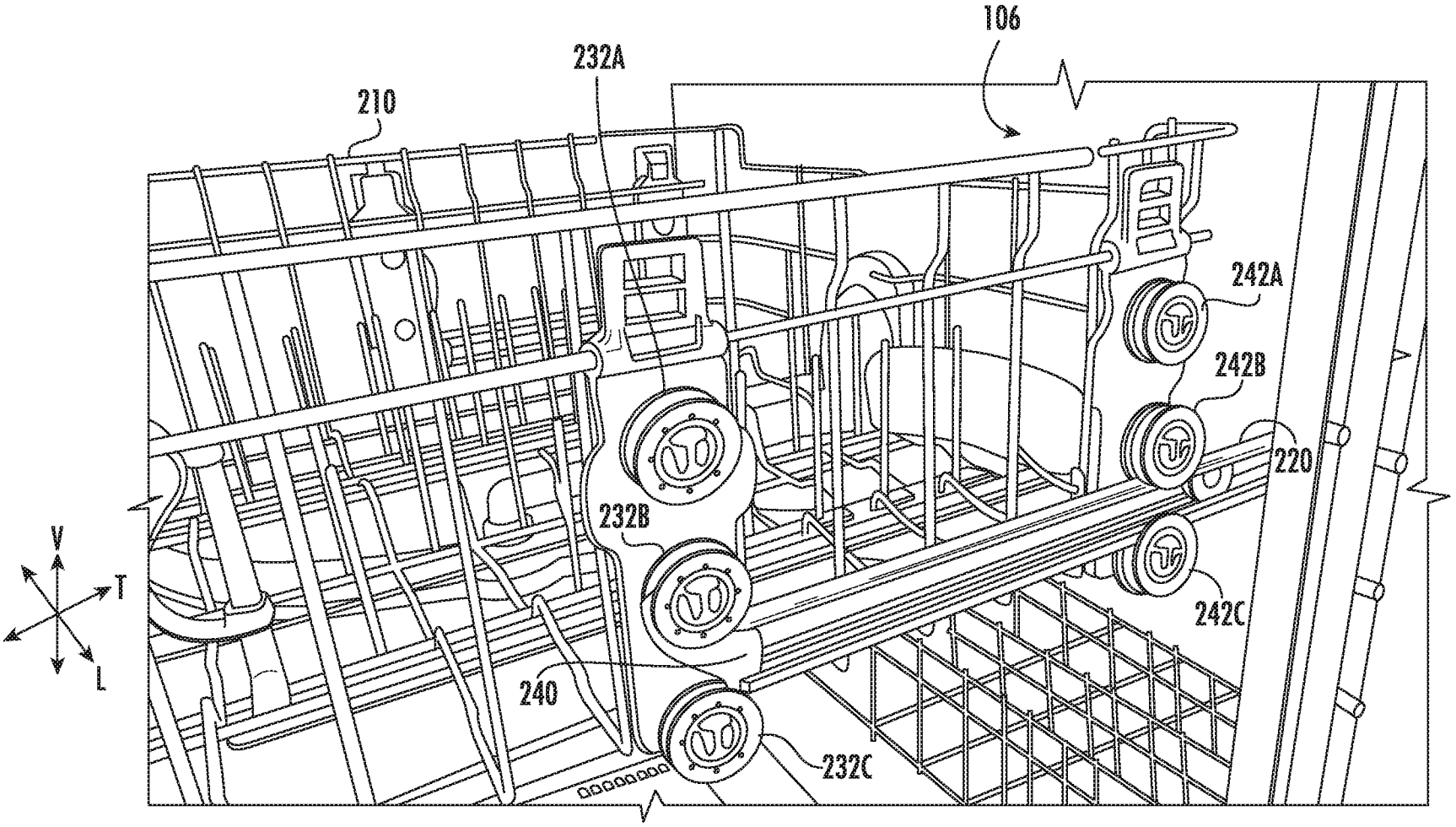
FIG. 3 provides a partial, perspective view of an adjustable rack assembly of an exemplary dishwasher appliance, the rack assembly being in an extended position.
Figure 4:
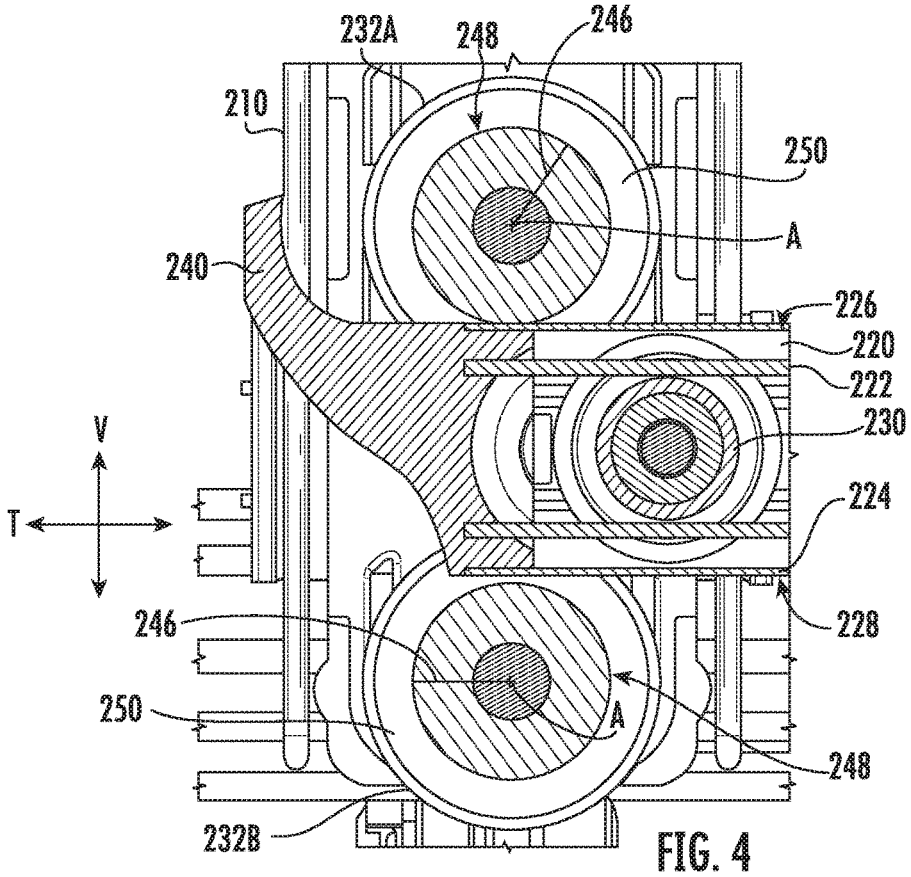
FIG. 4 provides a partial, cross-sectional side view of the exemplary rack assembly of FIG. 3, the rack assembly being in a retracted position.

Turning especially to FIGS. 2 and 3, FIG. 3 illustrates a front, partial perspective view of a rack assembly (e.g., rack assembly 130) according to an exemplary embodiment of the present disclosure (e.g., in an extended position). As described below, dishwasher appliance 100 includes one or more features for permitting easy removal/mounting of rack 210 within wash chamber 106 or movement of rack 210 to different heights (i.e., height settings) along the vertical direction V such that rack 210 may be placed in various predetermined positions along the vertical direction V. Although a rack 210 may be removable from wash chamber 106 and separable from the rest of dishwasher appliance 100, the vertical direction V, lateral direction L, and transverse direction T described with respect to various elements of rack assembly 130 are, except as otherwise indicated, generally understood to correspond to the position of those elements when rack assembly 130 is mounted within wash chamber 106 and to the rest of appliance 100 (e.g., such that rack 210 can slide along a frame 220 in or along the transverse direction T).

It is noted that although adjustable rack assembly 130 is described as an upper rack assembly, alternative embodiments may include the adjustable rack assembly 130 at another suitable location (e.g., as a lower rack assembly). Moreover, although described within the context of a dishwasher appliance, the present disclosure may be utilized in any other suitable appliance, such as a refrigerator appliance.

In some embodiments, multiple rows of wheels bound a frame 220 of a corresponding slide assembly (e.g., slide assembly 124) at each unique height setting (e.g., when rack assembly 130, including removable rack 210, is mounted within wash chamber 106). As shown, a frame 220 of a slide assembly 124 may be mounted within wash chamber 106 at each lateral sidewall 128 of wash chamber 106. In some embodiments, each frame 220 includes a pair of mated rails 222, 224. For instance embodiments, a first rail 222 may be fixed within wash chamber 106 (e.g., mounted to a sidewall 128 of wash chamber 106). A second rail 224 may be slidably attached to first rail 222. Generally, first and second rails 222 and 224 are mounted to each other such that first and second rails 222 and 224 are slidable relative to each other. For instance, the attachment between first and second rails 222 and 224 can permit movement or sliding of second rail 224 relative to first rail 222 along the transverse direction T (e.g., parallel to the transverse direction T). An internal bearing 230 positioned between the first and second rails 222 and 224 may, optionally, reduce friction and facilitate relative movement of first and second rails 222 and 224. Moreover, although two rails 222 and 224 are illustrated, further embodiments may include additional rails or bearings slidably mounted to first and second rails 222 and 224 to permit further extension of frame 220, as would be understood.

In some embodiments, a set of front wheels is provided on rack 210 (e.g., at each lateral side of rack 210). For instance, the set of front wheels may include a first front wheel 232A and a second front wheel 232B at the same lateral side of rack 210. In optional embodiments, a third front wheel 232C is also included at the same lateral side. As would be understood, further optional embodiments may include additional front wheels.

As will be described below, front end cap 240 may receive or catch at least one wheel of the set of front wheels 232A, 232B, 232C when rack 210 is pulled outward from wash chamber 106 (e.g., to the extended position) and may prevent excessive extension or travel of rack assembly 130 (e.g., along the vertical direction V T).

Each wheel of the set of front wheels 232A, 232B, 232C may be attached to rack 210. For example, each wheel 232A, 232B, 232C may be rotatably attached to rack 210 (e.g., at a bracket fixed to rack 210) to rotate about a unique rotation axis A. Each rotation axis A of front wheels 232A, 232B, 232C may be parallel to the other rotation axes A of front wheels 232A, 232B, 232C and, in certain embodiments, parallel to the lateral direction L (e.g., when rack 210 is mounted within wash chamber 106 and on frame 220). When rack 210 is mounted on frame 220 (e.g., as illustrated in FIGS. 2 through 5), each front wheel 232A, 232B, 232C is vertically aligned with the other front wheels 232A, 232B, 232C. For instance, the front wheels 232A, 232B, 232C may be positioned parallel to the vertical direction V such that each rotation axis A of the front wheels 232A, 232B, 232C is orthogonal to a common line extending along the vertical direction V. Thus, first front wheel 232A is vertically aligned to second front wheel 232B. Third front wheel 232C may further be vertically aligned to first front wheel 232A and second front wheel 232B. First front wheel 232A may be positioned above second front wheel 232B (e.g., in or along the vertical direction V when rack 210 is mounted to frame 220). Second front wheel 232B may be positioned above third front wheel 232C (i.e., between first front wheel 232A and third front wheel 232C in or along the vertical direction V). When mounted to frame 220, first front wheel 232A may generally be positioned above frame 220.

A unique height setting may be defined between each adjacent (e.g., vertically-adjacent) pair of front wheels 232A, 232B, 232C. As an example, a first height setting may be defined along the vertical direction V between first front wheel 232A and second front wheel 232B. Rack 210 may thus be considered to be mounted at the first height setting when first front wheel 232A is positioned over or above frame 220 (e.g., to rotate on or along an upper surface 226 of frame 220) and second front wheel 232B is positioned under or beneath frame 220 (e.g., to rotate or slide below a lower surface 228 of frame 220). As another example, a second height setting may be defined below the first height setting. In particular, the second height setting may be defined along the vertical direction V between second front wheel 232B and third front wheel 232C. rack 210 may thus be considered to be mounted at the second height setting when second front wheel 232B is positioned over or above frame 220 (e.g., to rotate on or along upper surface 226 of frame 220) and third front wheel 232C is positioned under or beneath frame 220 (e.g., to rotate or slide below lower surface 228 of frame 220). When rack 210 is mounted at the second height setting, it is thus positioned higher (e.g., relative to the bottom portion of tub 104—FIG. 2) than when rack 210 is mounted at the first height setting. Optional embodiments may include further height settings. Advantageously, rack 210 may have the same transverse extension or travel, regardless of the height setting at which it is mounted relative to frame 220. In other words, rack 210 may be pulled out to the same transverse length at each of the predetermined height settings of rack assembly 130.

In some embodiments, a set of rear wheels is provided on rack 210 (e.g., at each lateral side of rack 210). The set of rear wheels may include a first rear wheel 242A and a second rear wheel 242B at the same lateral side of rack 210. In optional embodiments, a third rear wheel 242C is included at the same lateral side or rack 210. Further optional embodiments may include additional rear wheels.

Each wheel of the set of rear wheels 242A, 242B, 242C may be attached to rack 210. For example, each rear wheel 242A, 242B, 242C may be rotatably attached to rack 210 (e.g., at a bracket fixed to rack 210) to rotate about a unique rotation axis A. Each rotation axis A of rear wheels 242A, 242B, 242C may be parallel to the other rotation axes A of the rear wheels 242A, 242B, 242C and, in certain embodiments, parallel to the lateral direction L (e.g., when rack 210 is mounted within wash chamber 106 and on frame 220). In optional embodiments, when rack 210 is mounted on frame 220 (e.g., as illustrated in FIGS. 2 through 5), each rear wheel 242A, 242B, 242C is vertically aligned with the other rear wheels 242A, 242B, 242C.

For instance, the rear wheels 242A, 242B, 242C may be positioned parallel to the vertical direction V such that each rotation axis A of rear wheels 242A, 242B, 242C is orthogonal to a common line extending along the vertical direction V. Thus, first rear wheel 242A may be vertically aligned to second rear wheel 242B. Third rear wheel 242C may further be vertically aligned to first rear wheel 242A and second rear wheel 242B. First rear wheel 242A may be positioned above second rear wheel 242B (e.g., in or along the vertical direction V when rack 210 is mounted to frame 220). Second rear wheel 242B may be positioned above third rear wheel 242C (i.e., between first rear wheel 242A and third rear wheel 242C in or along the vertical direction V). When mounted to frame 220, first rear wheel 242A may generally be positioned above frame 220.

As illustrated, the set of rear wheels 242A, 242B, 242C is generally spaced apart from (e.g., rearward relative to) the set of front wheels 232A, 232B, 232C in or along the transverse direction T. Each rear wheel 242A, 242B, 242C may be transversely aligned with a corresponding front wheel 232A, 232B, 232C (e.g., parallel to the transverse direction T such that each rotation axis A of a rear wheel 242A, 242B, 242C is orthogonal to a common line extending along the transverse direction T to a corresponding front wheel 232A, 232B, 232C). When rack 210 is mounted on frame 220, at least one rear wheel 242A, 242B, 242C may thus further support rack 210 on frame 220. First rear wheel 242A may be transversely aligned with first front wheel 232A. Second rear wheel 242B may be transversely aligned with second front wheel 232B. Third rear wheel 242C may be transversely aligned with third front wheel 232C. A transverse spacing 244 may be defined between each transversely-aligned pair of front and rear wheels from the rotation axis A of a front wheel to the rotation axis A of the transversely-aligned rear wheel). Optionally, the transverse spacing 244 between each transversely-aligned may be equal.

With the set of front wheels 232A, 232B, 232C, the set of rear wheels 242A, 242B, 242C may further define the unique height settings. As an example, the first height setting may be further defined along the vertical direction V between first rear wheel 242A and second rear wheel 242B. In the first height setting, first rear wheel 242A may be positioned over or above frame 220 (e.g., to rotate or slide on an upper surface 226 of frame 220) and second rear wheel 242B may be positioned under or beneath frame 220 (e.g., to rotate or slide on a lower surface 228 of frame 220). As another example, the second height setting may be further defined along the vertical direction V between second rear wheel 242B and third rear wheel 242C. In the second height setting, second rear wheel 242B may be positioned over or above frame 220 (e.g., to rotate or slide on an upper surface 226 of frame 220) and third rear wheel 242C may be positioned under or beneath frame 220 (e.g., to rotate or slide on a lower surface 228 of frame 220).

An end cap 240 is attached to the frame 220 at a forward end thereof to catch one of the wheels (e.g., a front wheel 232A, 232B, 232C) in an extended position and prevent excessive movement of the rack 210 (e.g., along the transverse direction T). A user can move rack 210 to adjust or shift upper rack assembly 130 upwardly or downwardly along the vertical direction V (e.g., relative to tub sump portion 142 or lower rack assembly 132). Such adjustment can permit larger dishes to be loaded into upper or lower rack assemblies 130 and 132.

Figure 5:
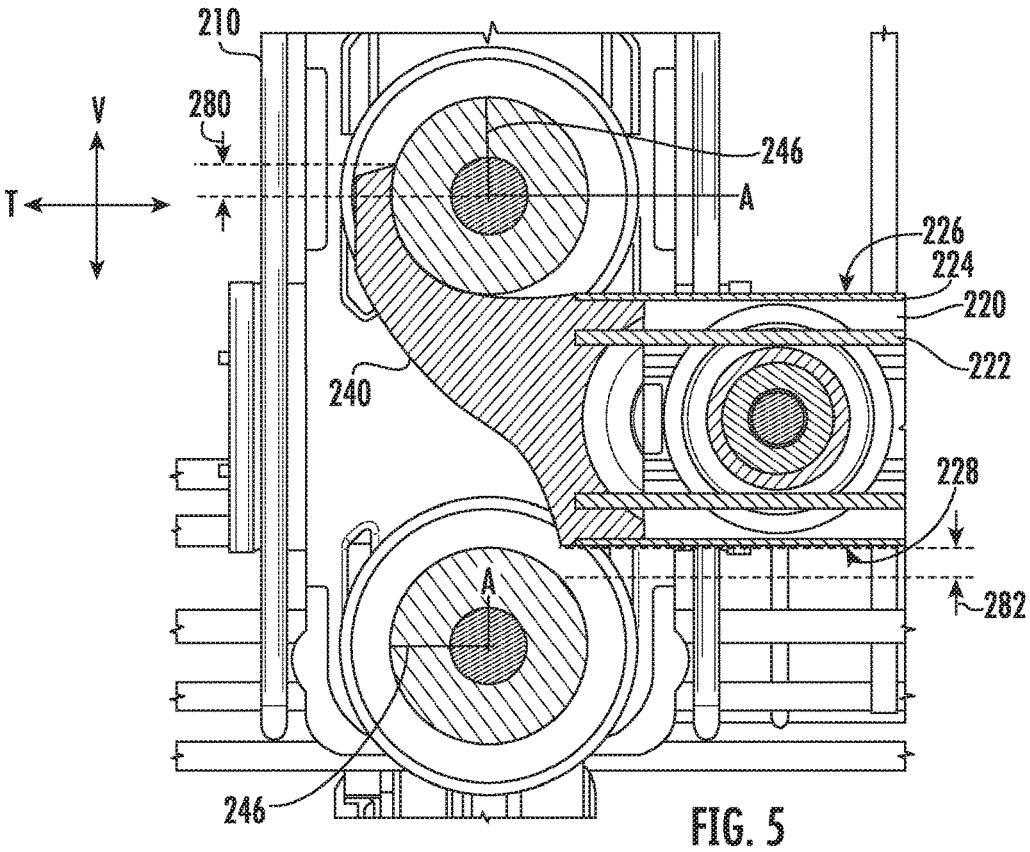
FIG. 5 provides a partial, cross-sectional side view of the exemplary rack assembly of FIG. 3, the rack assembly being in an extended position.
Figure 6:
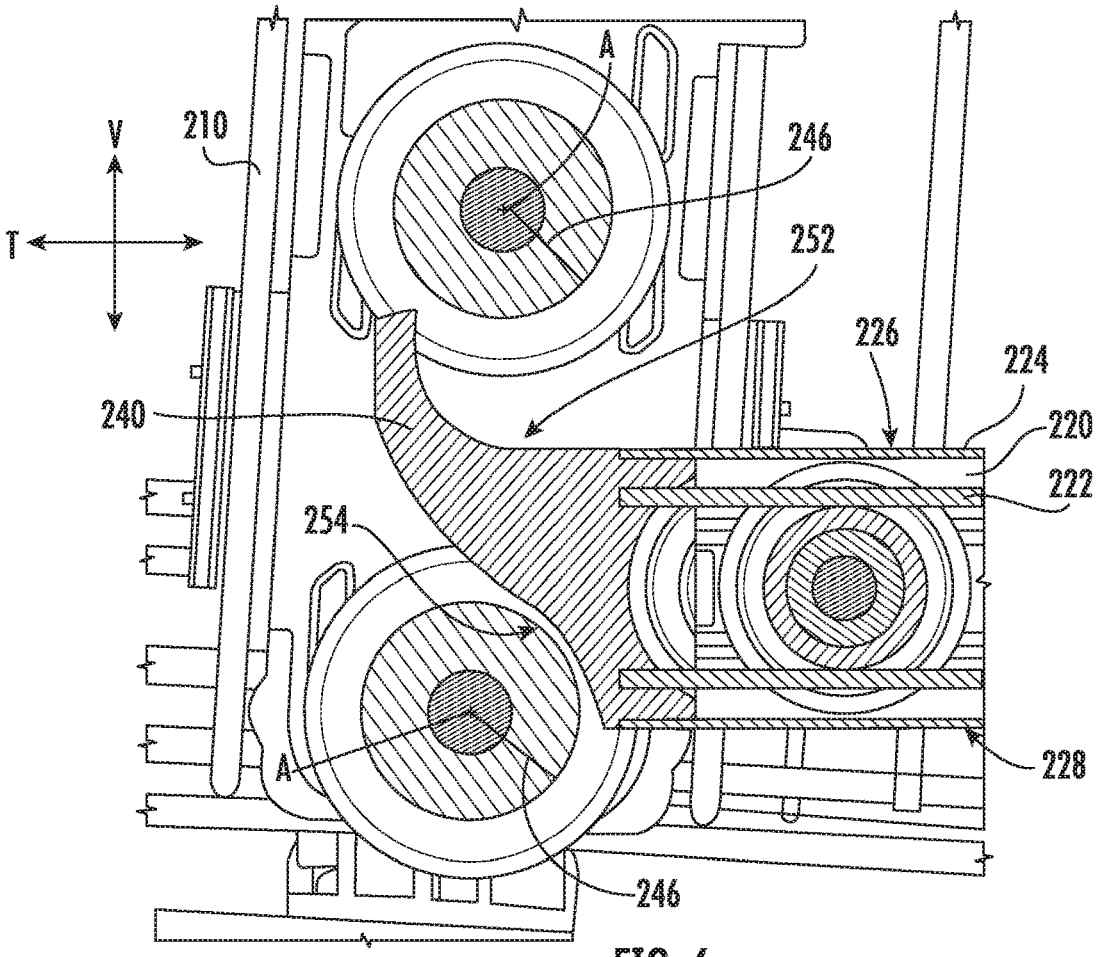
Figure 7:
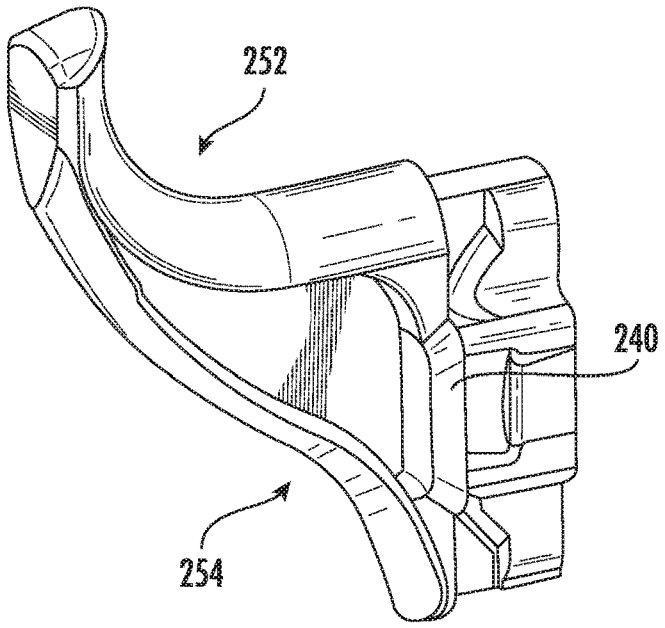
FIG. 7 provides a perspective view of an end cap for a rack assembly according to exemplary embodiments of the present disclosure.
Figure 8:
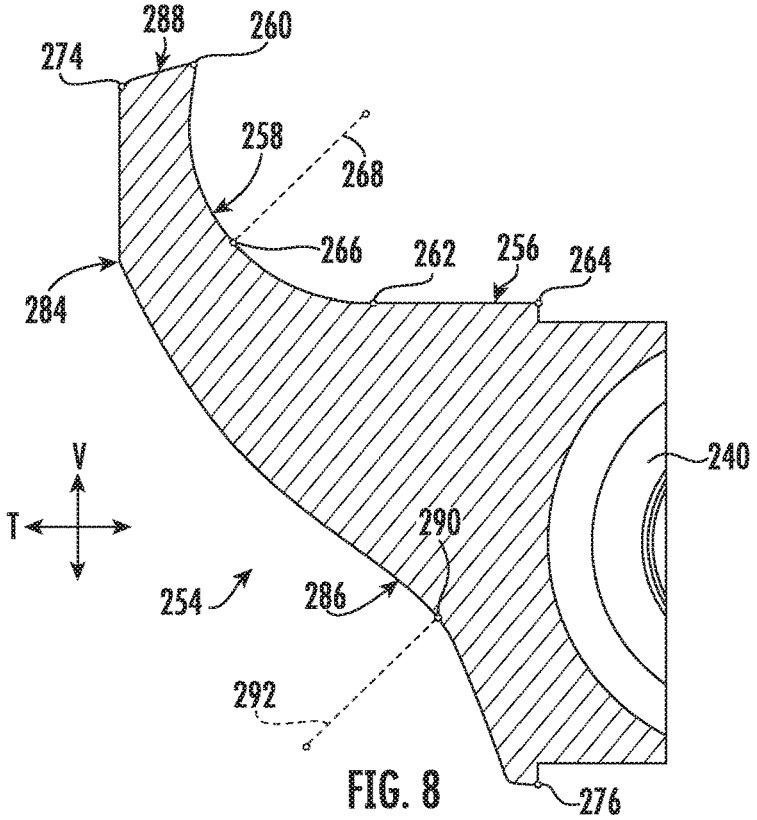
FIG. 8 provides a cross-sectional side view of the exemplary end cap of FIG. 6.
Figure 9:
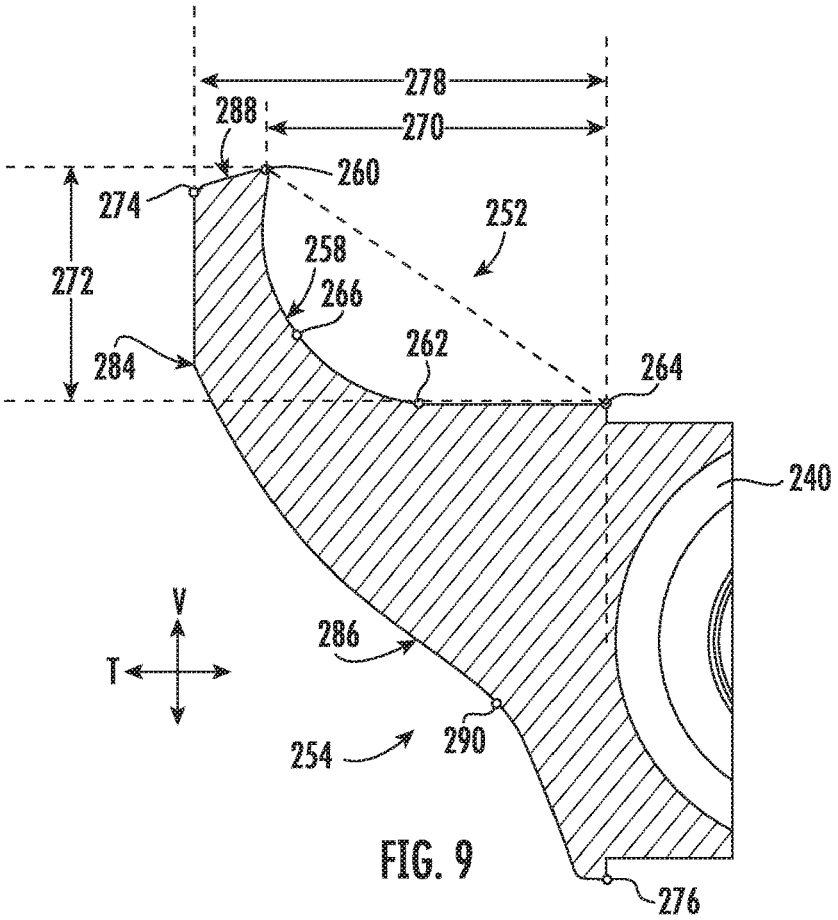
FIG. 9 provides another cross-sectional side view of the exemplary end cap of FIG. 6.

Turning now to FIGS. 3 through 6, FIGS. 4 and 5 illustrate a cross-sectional side view of rack assembly 130 as it moves between a retracted position (e.g., partially retracted position—FIG. 4) and an extended position (FIG. 5). FIG. 6 illustrates a similar view wherein rack assembly 130 is in a tilted position (e.g., to be adjusted or removed from frame 220).

As shown, when rack 210 is slidably mounted to frame 220, a pair of wheels may bound frame 220. In particular, at least one wheel (e.g., first front wheel 232A) may be positioned on an upper surface 226 (e.g., uppermost vertical extreme) of frame 220 while another wheel (e.g., second front wheel 232B) may be positioned below a lower surface 228 (e.g., lowermost vertical extreme) of frame 220. In some embodiments, each of the bounding wheels defines a wheel radius 246. Each wheel radius 246 may extend from a corresponding rotation axis A to a rolling contact surface 248 of wheel. As an example, in the illustrated embodiments and positions of FIGS. 4 and 5, the wheel radius 246 of first front wheel 232A extends perpendicularly from the corresponding rotation axis A and to the rolling contact surface 248, which rotates along upper surface 226 (e.g., in contact therewith). In some embodiments, each bounding wheel (e.g., each wheel of the set of front wheels 232A, 232B, 232C) defines a wheel radius 246 that is equal to the wheel radius 246 of the other wheel(s). Thus, first front wheel 232A may define a wheel radius 246, and second front wheel 232B may define a wheel radius 246 that is equal (e.g., in length or magnitude) to the wheel radius 246 of the first front wheel 232A.

Optionally, one or more guide flares 250 may extend radially outward from the contact surface 248 of each wheel (e.g., at opposite lateral sides of the corresponding wheel) and laterally bound frame 220 to maintain lateral alignment between the wheel and frame 220.

Turning now to FIGS. 4 through 9, FIGS. 7 through 9 illustrate various views of end cap 240 according to exemplary embodiments. As shown, end cap 240 may be attached to frame 220 (e.g., at a forward end thereof). For example a friction fit may be formed between end cap 240 and second rail 224 (e.g., such that end cap 240 slides with second rail 224 relative to first rail 222). Additionally or alternatively, a suitable mechanical fastener or adhesive may join end cap 240 to frame 220 (e.g., at second rail 224).

End cap 240 generally defines an outer profile across which one or more of the wheels (e.g., front wheels 232A, 232B, 232C) may move. This outer profile may include a top-end catch profile 252 (TCP) and a bottom-end relief profile 254 (BRP). When assembled (e.g., when end cap 240 is attached to frame 220), TCP 252 is directed rearward along the transverse direction T. Thus, TCP 252 generally faces wash chamber 106 (FIG. 2) and a back wall thereof. If viewed from inside the wash chamber 106 and, for example, at the same vertical height as end cap 240, TCP 252 may be visible. In contrast to TCP 252, BRP 254 is directed forward along the transverse direction T. Thus, BRP 254 generally faces away from wash chamber 106 (FIG. 2) and toward the region in front of appliance 100 (FIG. 2). If viewed from outside wash chamber 106 (e.g., directly in front of appliance 100 with the door 120—FIG. 2—opened) and, for example, at the same vertical height as end cap 240, BRP 254 may be visible. When assembled, TCP 252 extends smoothly or uninterrupted from upper surface 226 such that, for instance, first front wheel 232A may roll or slide smoothly from upper surface 226 to TCP 252. Additionally or alternatively, BRP 254 extends smoothly or uninterrupted from lower surface 228 such that, for instance, second front wheel 232B may roll or slide unhalted from a point directly beneath lower surface 228 to a point directly beneath BRP 254.

Generally, TCP 252 has a separate transverse profile segment 256 and vertical profile segment 258. As illustrated, vertical profile segment 258 extends from and above transverse profile segment 256. In particular, vertical profile segment 258 extends generally in vertical direction V from a base point 262 at transverse profile segment 256 to a vertical tip 260 positioned higher than base point 262 in the vertical direction V. The vertical tip 260 may define the upper extreme of vertical profile segment 258 or end cap 240 along the vertical direction V. Transverse profile segment 256 may extend parallel to the transverse direction T and, for example, from the upper surface 226 of frame 220. In particular, transverse profile segment 256 may define a surface parallel to the transverse direction T extending from a start point 264 to the base point 262.

In the extended position, vertical profile segment 258 may generally receive the corresponding front wheel (e.g., first front wheel 232A) as it slides or rolls forward from transverse profile segment 256. In some such embodiments, vertical profile segment 258 is positioned forward relative to front wheel 232A, 232B, 232C (e.g., further from wash chamber 106 in the transverse direction T). Engagement or contact between the front wheel 232A, 232B, 232C and vertical profile segment 258 may halt further forward transverse movement of rack 210. In optional embodiments, when rack 210 is mounted to frame 220 (e.g., in the extended position), vertical tip 260 is positioned above (e.g., higher in the vertical direction V) than the rotation axis A of a corresponding front wheel (e.g., first front wheel 232A). In such embodiments, the vertical distance between vertical tip 260 and the rotation axis A is defined as a vertical excess 280.

In certain embodiments, vertical profile segment 258 is gradually curved upward. In other words, the outer surface of vertical profile segment 258 extends arcuately in transverse direction T and vertical direction V from transverse profile segment 256 to the vertical tip 260. The curvature of vertical profile segment 258 may define a vertex (e.g., top vertex 266). Moreover, the curvature may define a radius (e.g., top arcuate radius 268) extending rearward from vertical profile segment 258. For instance, the top arcuate radius 268 may extend from the top vertex 266. In exemplary embodiments, top arcuate radius 268 is greater than or equal to the wheel radius 246 of the corresponding front wheel (e.g., first front wheel 232A). As rack 210 moves between a retracted and extended position, the corresponding front wheel 232A may advantageously move smoothly to/from the extended position without inadvertently rolling above the vertical tip 260.

In optional embodiments, the curvature of vertical profile segment 258 defines a constant radius between transverse profile segment 256 and vertical tip 260. Top vertex 266 may be defined at the midpoint between transverse profile segment 256 and vertical tip 260. As shown, vertical profile segment 258 generally defines a discrete inner transverse length 270 and top vertical height 272 from start point 264 to vertical tip 260. In certain embodiments, the top vertical height 272 is greater than the diameter of the corresponding front wheel (i.e., double the wheel radius 246). In additional or alternative embodiments, the inner transverse length 270 is less than the diameter of the corresponding front wheel. As an example, the inner transverse length 270 may be between about 95% and about 100% of the diameter. As another example, the inner transverse length 270 may be about 99% of the diameter.

In some embodiments, BRP 254 generally defines a slightly sloped or S-shaped surface generally extending rearward from a front point 274 (e.g., outermost extreme in the transverse direction T) to a rear point 276 (e.g., innermost extreme in the transverse direction T) opposite from TCP 252. An outer transverse length 278 may be defined along the transverse direction T between front point 274 and rear point 276. As shown, outer transverse length 278 may be longer than inner transverse length 270. Rear point 276 may generally be at the same vertical height as lower surface 228 of frame 220. Moreover, rear point 276 may define the lowermost point of end cap 240 along the vertical direction V. In some such embodiments, when rack 210 is mounted to frame 220 in the extended position, rear point 276 is positioned directly above a portion of the corresponding front wheel (e.g., second front wheel 232B). The vertical distance between rear point 276 and the surface of the corresponding wheel 232B directly beneath rear point 276 may be defined as a vertical gap 282. Optionally, the ratio of the vertical gap 282 over the vertical excess 280 may be a predefined clearance ratio between about 1.0 and about 2.0. Additionally or alternatively, the clearance ratio may be about 1.3.

A concave profile segment 286 of BRP 254 may extend from rear point 276 to a convex profile segment 284, which itself may extend to front point 274. An intermediate segment 288 may connect BRP 254 and TCP 252 (e.g., extending generally along the transverse direction T from vertical tip 260 to front point 274).

When rack 210 is in the extended position, at least a portion of BRP 254 is positioned rearward relative to a corresponding front wheel (e.g., second front wheel 232B) beneath BRP 254. For example, a portion of concave profile segment 284 may be positioned further rearward and closer to wash chamber 106 (FIG. 2) in the transverse direction T than an outermost (i.e., forward most) surface of the corresponding wheel. In some embodiments, concave profile segment 286 defines a vertex (e.g., bottom vertex 290). In some such embodiments, the bottom vertex 290 is positioned rearward relative to the rotation axis A of the corresponding front wheel 232B in the transverse direction T. In other words, bottom vertex 290 is behind the rotation axis A of the corresponding front wheel 232B. In additional or alternative embodiments, bottom vertex 290 is defined or positioned rearward relative to (e.g., behind) top vertex 266. In further additional or alternative embodiments, bottom vertex 290 is defined or positioned rearward relative to (e.g., behind) at least a portion of transverse profile segment 256 in the transverse direction T. A radius (e.g., bottom arcuate radius 292) may be defined to extend forward from bottom vertex 290. In exemplary embodiments, bottom arcuate radius 292 is greater than or equal to the wheel radius 246 of the corresponding front wheel (e.g., second front wheel 232B).

As shown, especially at FIG. 6, removal of rack 210 (e.g., from the extended mounted position) may be permitted by tilting rack 210 relative to frame 220. The above-described embodiments and features may advantageously permit rack 210 to be inclined to the tilted position illustrated at FIG. 6. For instance, rack 210 may tilt about the upper wheel resting on frame 220 (e.g., about first rear wheel 242A—FIG. 3). In the tilted position, the upper front wheel (e.g., first front wheel 232A) is lifted above the vertical tip 260 of end cap 240. The lower front wheel (e.g., second front wheel 232B) may be received within a portion of BRP 254 (e.g., within concave segment 286). In certain embodiments, the angle of incline for rack 210 relative to the extended position is a preset angle between, for instance, about 2.0° and about 5.0°. In other words, the difference in orientation of rack 210 between the extended position and the tilted position is defined by the preset angle. From the tilted position, rack 210 may be pulled forward along the transverse direction T and removed from frame 220. Once removed, rack 210 may be moved to a new (or returned the same) height setting. Mounting rack 210 to frame 220 may generally follow a reverse motion from removal.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A rack assembly comprising:

a frame positioned within a wash chamber of a dishwasher appliance;

a rack selectively mounted to the frame to receive articles for washing, the rack being slidable along the frame in a transverse direction between an extended position and a retracted position;

a first front wheel rotatably attached to the rack above the frame;

a second front wheel rotatably attached to the rack below the first front wheel in vertical alignment with the first front wheel; and an end cap attached to the frame at a forward end thereof, the end cap defining a top-end catch profile directed rearward along the transverse direction, the top-end catch profile having a transverse profile segment and a vertical profile segment extending from and above the transverse profile segment to receive the first front wheel in the extended position, and a bottom-end relief profile directed forward along the transverse direction, wherein the bottom-end relief profile is a forwardmost surface of the end cap having a concave profile segment curving away from a front end to a bottom vertex, and wherein the bottom vertex is positioned rearward relative to at least a portion of the transverse profile.

2. The rack assembly of claim 1, wherein the first front wheel defines a wheel radius, and wherein the second front wheel defines a wheel radius equal to the wheel radius of the first front wheel.

3. The rack assembly of claim 1, further comprising a third front wheel rotatably attached to the rack in vertical alignment with the first and second front wheels.

4. The rack assembly of claim 1, further comprising:

a first rear wheel rotatably mounted to the frame rearward relative to the first front wheel, the first rear wheel being transversely aligned with the first front wheel; and a second rear wheel rotatably mounted to the frame rearward relative to the second front wheel, the second rear wheel being transversely aligned with the second front wheel.

5. The rack assembly of claim 1, wherein at least a portion of the vertical profile segment is positioned forward relative to the first front wheel.

6. The rack assembly of claim 1, wherein at least a portion of the bottom-end relief profile is positioned rearward relative to a portion of second front wheel in the extended position.

7. The rack assembly of claim 1, wherein the vertical profile segment defines a top vertex, and wherein the top vertex is defined forward relative to the bottom vertex.

8. The rack assembly of claim 1, wherein the concave profile segment defines a bottom arcuate radius forward therefrom, wherein the second front wheel defines a wheel radius, and wherein the wheel radius of the second front wheel is less than or equal to the bottom arcuate radius.

9. The rack assembly of claim 1, wherein the vertical profile segment defines a top arcuate radius rearward therefrom, wherein the first front wheel defines a wheel radius, and wherein the wheel radius of the first front wheel is less than or equal to the top arcuate radius.

10. The rack assembly of claim 1, wherein the first front wheel defines a rotation axis, and wherein a vertical tip of the top-end catch profile is positioned above the rotation axis of the first front wheel in the extended position.

11. The rack assembly of claim 1, wherein the second front wheel defines a rotation axis, wherein the bottom-end relief profile defines a bottom vertex, and wherein the bottom vertex is positioned forward relative to the rotation axis of the second front wheel in the extended position.

12. A rack assembly comprising:

a frame positioned within a wash chamber of a dishwasher appliance;

a rack selectively mounted to the frame to receive articles for washing, the rack being slidable along the frame in a transverse direction between an extended position and a retracted position;

a first front wheel rotatably attached to the rack above the frame;

a second front wheel rotatably attached to the rack below the first front wheel in vertical alignment with the first front wheel; and an end cap attached to the frame at a forward end thereof, the end cap defining a top-end catch profile having a transverse profile segment and a vertical profile segment extending arcuately from and above the transverse profile segment to receive the first front wheel in the extended position, the vertical profile segment defining a top vertex, and a bottom-end relief profile having a concave profile segment directed forward and defining a bottom vertex and being directed forward along the transverse direction, wherein the top vertex is defined forward relative to the bottom vertex in the transverse direction, wherein at least a portion of the transverse profile segment is defined forward relative to the bottom vertex along the transverse direction, wherein the bottom-end relief profile is a forwardmost surface of the end cap, and wherein the concave profile segment curves away from a front end to the bottom vertex.

13. The rack assembly of claim 12, wherein the first front wheel defines a wheel radius, and wherein the second front wheel defines a wheel radius equal to the wheel radius of the first front wheel.

14. The rack assembly of claim 12, further comprising a third front wheel rotatably attached to the rack in vertical alignment with the first and second front wheels.

15. The rack assembly of claim 12, further comprising:

a first rear wheel rotatably mounted to the frame rearward relative to the first front wheel, the first rear wheel being transversely aligned with the first front wheel; and a second rear wheel rotatably mounted to the frame rearward relative to the second front wheel, the second rear wheel being transversely aligned with the second front wheel.

16. The rack assembly of claim 12, wherein at least a portion of the vertical profile segment is positioned forward relative to the first front wheel, and wherein at least a portion of the bottom-end relief profile is positioned rearward relative to the second front wheel.

17. The rack assembly of claim 12, wherein the vertical profile segment defines a top arcuate radius rearward therefrom, wherein the concave profile segment defines a bottom arcuate radius forward therefrom, wherein the first front wheel defines a wheel radius less than or equal to the top arcuate radius, wherein the second front wheel defines a wheel radius less than or equal to the bottom arcuate radius.

18. The rack assembly of claim 12, wherein the first front wheel defines a rotation axis, wherein the second front wheel defines a rotation axis, wherein a vertical tip of the top-end catch profile is positioned above the rotation axis of the first front wheel in the extended mounted position, and wherein the bottom vertex is positioned forward relative to the rotation axis of the second front wheel in the extended mounted position.

* * * * *